US008786235B1

(12) United States Patent
Mosley

(10) Patent No.: US 8,786,235 B1
(45) Date of Patent: Jul. 22, 2014

(54) SOLAR-POWERED AUTOMATIC CURTAIN OPENER

(76) Inventor: Jeffery S. Mosley, Denver, IN (US)

( * ) Notice: Subject to any disclaimer, the term of this patent is extended or adjusted under 35 U.S.C. 154(b) by 477 days.

(21) Appl. No.: 13/267,555

(22) Filed: Oct. 6, 2011

Related U.S. Application Data

(60) Provisional application No. 61/390,204, filed on Oct. 6, 2010.

(51) Int. Cl.
*G05B 5/00* (2006.01)

(52) U.S. Cl.
USPC ..... 318/466

(58) Field of Classification Search
CPC ..... H02H 7/0851; E05Y 2900/106; E05F 15/1607; E05F 15/0004; B60J 7/0573
USPC ..... 318/466
See application file for complete search history.

(56) References Cited

U.S. PATENT DOCUMENTS

| | | | | |
|---|---|---|---|---|
| 6,459,033 | B1 * | 10/2002 | Muller | 136/244 |
| 2005/0172563 | A1 * | 8/2005 | Komoda | 49/358 |
| 2006/0196614 | A1 * | 9/2006 | Strand et al. | 160/124 |
| 2006/0274218 | A1 * | 12/2006 | Xue | 349/16 |
| 2008/0236763 | A1 * | 10/2008 | Kates | 160/5 |
| 2009/0284670 | A1 * | 11/2009 | Xue | 349/16 |
| 2011/0061711 | A1 * | 3/2011 | Luo et al. | 136/244 |
| 2012/0097348 | A1 * | 4/2012 | Kanehira et al. | 160/370.21 |
| 2012/0103394 | A1 * | 5/2012 | Khazeni et al. | 136/246 |
| 2012/0285630 | A1 * | 11/2012 | Berman et al. | 160/1 |

* cited by examiner

*Primary Examiner* — Shawki S Ismail
*Assistant Examiner* — Zoheb Imtiaz
(74) *Attorney, Agent, or Firm* — Robert C. Montgomery; Montgomery Patent & Design

(57) ABSTRACT

A solar-powered automatic curtain opener comprises a housing, sensors, a motor, a pair of extendable rods, and a photovoltaic power supply. The housing provides an enclosure for various electrical components of the apparatus including the motor and battery. The sensor automatically actuates the motor based upon ambient light conditions which extends or retracts the rods to selectively open or close a curtain as appropriate. The motor is powered by a battery charged via a photovoltaic cell assembly. When ambient light conditions below a desired threshold are detected, stored energy is utilized in order to close the curtain assembly. The motor is further operable by a user to selectively open or close the curtain. In one embodiment, the housing further comprises a receiver which allows a user to remotely control the open or closed state of the curtains via a corresponding remote control assembly.

17 Claims, 8 Drawing Sheets

SOLAR-POWERED AUTOMATIC CURTAIN OPENER

RELATED APPLICATIONS

The present invention was first described in and claims the benefit of U.S. Provisional Application No. 61/390,204 filed on Oct. 6, 2010, the entire disclosures of which are incorporated herein by reference.

FIELD OF THE INVENTION

The present invention relates generally to an apparatus for opening and closing window curtains, and in particular, to an autonomously functioning solar-powered apparatus for opening and closing window curtains.

BACKGROUND OF THE INVENTION

Windows are valuable structures due to the fact that the enhance interior spaces with views, ambient light which saves on energy costs, and the ability to expose an interior space to the environment during periods of nice weather. The primary downside of windows is that they limit privacy. Thus, most windows are equipped with window curtains to provide privacy.

Curtains are often opened during the day to provide ambient light and a view, and closed at night when indoor lighting is utilized. In these cases, each curtain must be opened or closed by a user at least twice a day. However, depending on location, this may also require the user to climb over furniture, walk around tables, and reach over obstacles. This is particular problematic for users of limited or diminished physical capabilities.

Various attempts have been made to provide a curtain manipulating apparatus. Examples of these attempts can be seen by reference to several U.S. patents, including U.S. Pat. No. 4,902,953; U.S. Pat. No. 4,926,922; U.S. Pat. No. 4,995,442; and U.S. Pat. No. 6,024,156. However, none of these designs are similar to the present invention.

While these apparatuses fulfill their respective, particular objectives, each of these references suffer from one (1) or more disadvantages. Many such apparatuses do not provide a significant range of user adjustability or control. Many such apparatuses cannot be manually operated from a remote position. Many such apparatuses are not adapted to be easily installed, removed, adjusted, replaced, and powered. Accordingly, there exists a need for a means by which window curtains can be adjusted automatically without the disadvantages as described above. The development of the present invention substantially departs from the conventional solutions and in doing so fulfills this need.

SUMMARY OF THE INVENTION

In view of the foregoing references, the inventor recognized the aforementioned inherent problems and observed that there is a need for a readily transportable and autonomously functioning curtain manipulating apparatus providing a range of powered manual and automatic operation. Thus, the object of the present invention is to solve the aforementioned disadvantages and provide for this need.

To achieve the above objectives, it is an object of the present invention to enable a user to adjust the positioning of a curtain in a difficult to reach location within a home or building by providing automatic adjustment of the position of the curtain based upon selectable ambient conditions in order to mitigate the necessity of adjusting the curtains on a daily basis.

Another object of the present invention is to provide a powered adjustment means for individuals with physical ailments which inhibit such tasks.

Yet still another object of the present invention is to be transportable and functional without connection to an external power supply.

Yet still another object of the present invention is to enable both automatic and manual adjustment of existing curtains upon a window based upon ambient conditions or user input. The apparatus comprises a housing which contains a motor assembly and a plurality of electrical and electronic components.

Yet still another object of the present invention is to engage perimeter edges of the curtains with a pair of opposing telescoping arm assemblies. The arm assemblies are driven by the motor assembly.

Yet still another object of the present invention is to provide a transmission and couplings which translate rotational motion of the motor assembly into linear motion in order to extend and retract the pair of telescoping arm assemblies based upon input to a sensor assembly.

Yet still another object of the present invention is to comprise each arm assembly of a spring clip comprising a removable clamp fastener for gripping a portion of the curtain.

Yet still another object of the present invention is to removably attach the apparatus to a window or similar surface using a suction cup located on a rear panel of the housing.

Yet still another object of the present invention is to sustain continual automatic operation of the apparatus by comprising a solar panel located on the rear panel of the housing. The solar panel faces the exterior of the window and provides power to the electrical components of the apparatus.

Yet still another object of the present invention is to provide a control knob which enables the user to control the operational mode of the apparatus. The control knob is comprised of a multi-positional electrical knob which enables the user to choose a desired setting such as a normal mode which activates the arm assembly when the solar cell detects incoming light, a remote mode which enables the user to activate the assembly with a remote controller, a manual mode which enables a user to manually deploy the arm assembly, or a backwards mode which enables the arm assembly to be activated when the solar cell does not detect incoming light.

Yet still another object of the present invention is to comprise the transmission of a reel and guide assembly which provides linear motion to a pair of cord couplings fixed to distal ends of each of the pair of telescoping arm assemblies. Each section of the telescoping arm assembly further comprises an integral spring mechanism which biases each portion of the arm assembly towards an outwardly extended state such that the motor assembly may be actuated in order to provide an inward linear motion to the cord coupling and pull the telescoping sections of the arm assemblies inwardly against the force of the spring mechanism.

Yet still another object of the present invention is to provide an integral rechargeable battery which provides electrical power to the motor assembly, the control circuit, and the sensor assembly. The solar cells provide variable electrical current which is passed through a voltage regulator in order to provide a recharging current to the battery.

Yet still another object of the present invention is to comprise the sensor assembly of an electronic assembly which provides an input signal to the control circuit based upon ambient or user controlled conditions including a photo sensor, an RF receiver, and a manual actuator.

Yet still another object of the present invention is to comprise the photo sensor of a photoelectric sensor disposed along the rear panel the housing and adapted to provide an input signal to the control circuit based upon the ambient light level of the outdoors.

Yet still another object of the present invention is to provide a manual actuator comprised of a capacitor which enables the apparatus to be actuated by a user touching the housing.

Yet still another object of the present invention is to comprise the remote controller of a handheld device having a transmitter and a plurality of buttons for operating the apparatus.

Yet still another object of the present invention is to provide a method of utilizing the device that provides a unique means of acquiring the apparatus, fastening the apparatus to a set of curtains and a window, adjusting the control knob to a desired setting, controlling the telescoping arm assembly to deploy and retract based upon the setting, and utilizing the apparatus to open and close curtains in a powered and automated manner.

Further objects and advantages of the present invention will become apparent from a consideration of the drawings and ensuing description.

BRIEF DESCRIPTION OF THE DRAWINGS

The advantages and features of the present disclosure will become better understood with reference to the following more detailed description and claims taken in conjunction with the accompanying drawings, in which like elements are identified with like symbols, and in which:

Figure 1:
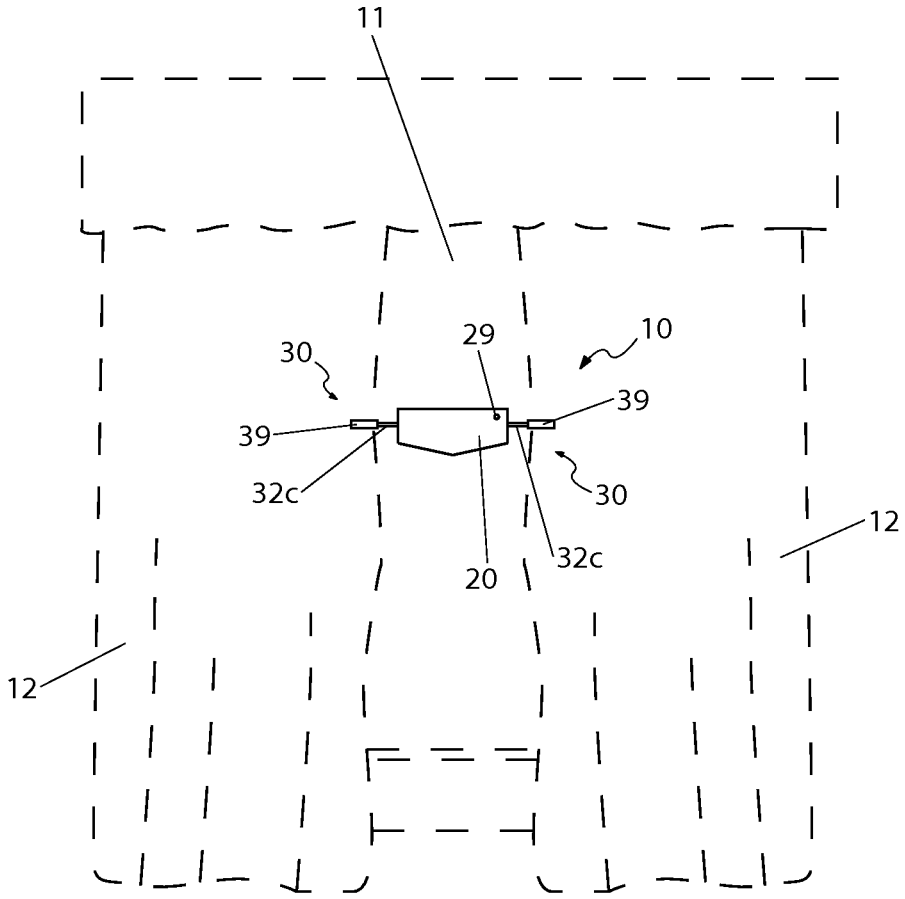
FIG. 1 is an environmental view of a motorized curtain opening and closing apparatus 10 depicting a closed state, according to a preferred embodiment of the present invention.

| DESCRIPTIVE KEY | |
|---|---|
| 10 | curtain opening and closing apparatus |
| 11 | window |
| 12 | curtain |
| 20 | housing |

-continued

| DESCRIPTIVE KEY | |
|---|---|
| 21a | front panel |
| 21b | side panel |
| 21c | top panel |
| 21d | rear panel |
| 21e | bottom panel |
| 22 | motor assembly |
| 23 | suction cup |
| 24 | battery |
| 25 | manual actuator |
| 26 | solar cell |
| 27 | control knob |
| 28 | voltage regulator |
| 29 | receiver |
| 30 | telescoping arm assembly |
| 32a | first telescoping section |
| 32b | second telescoping section |
| 32c | third telescoping section |
| 33 | photo sensor |
| 34 | transmission |
| 36 | coupler |
| 38 | spring mechanism |
| 39 | spring clip |
| 40 | control circuit |
| 42 | sensor assembly |
| 50 | indicia |
| 52 | adhesive |
| 60 | remote controller |
| 61 | first button |
| 62 | second button |
| 63 | battery compartment |
| 64 | remote battery |
| 65 | transmitter |
| 66 | signal |

DETAILED DESCRIPTION OF THE PREFERRED EMBODIMENT

In accordance with the invention, the best mode is presented in terms of a preferred embodiment, herein depicted within FIGS. 1 through 9. However, the disclosure is not limited to a single described embodiment and a person skilled in the art will appreciate that many other embodiments are possible without deviating from the basic concept of the disclosure and that any such work around will also fall under its scope. It is envisioned that other styles and configurations can be easily incorporated into the teachings of the present disclosure, and only one particular configuration may be shown and described for purposes of clarity and disclosure and not by way of limitation of scope.

The terms "a" and "an" herein do not denote a limitation of quantity, but rather denote the presence of at least one of the referenced items.

The present invention describes a curtain opening and closing apparatus (herein described as the "apparatus") 10 to enable a user to adjust curtains 12 hanging over a window 11. The apparatus 10 is intended to provide various benefits to a user over existing methods of opening, closing, and retaining curtains 12 upon a window 11. The apparatus 10 allows the user to adjust the positioning of a curtain 12 in a difficult to reach location within a home or building. The apparatus 10 also provides for automatic adjustment of the position of the curtain 12 based upon selectable ambient conditions in order to mitigate the necessity of adjusting the curtains 12 on a daily basis. The apparatus 10 further provides for powered curtain 12 adjustment to individuals with physical ailments which inhibit such tasks. The apparatus 10 enables households to save on energy costs and provides a security feature to homes or buildings. The apparatus 10 is transportable, is easily installed, and has no electrical cords.

Figure 2:
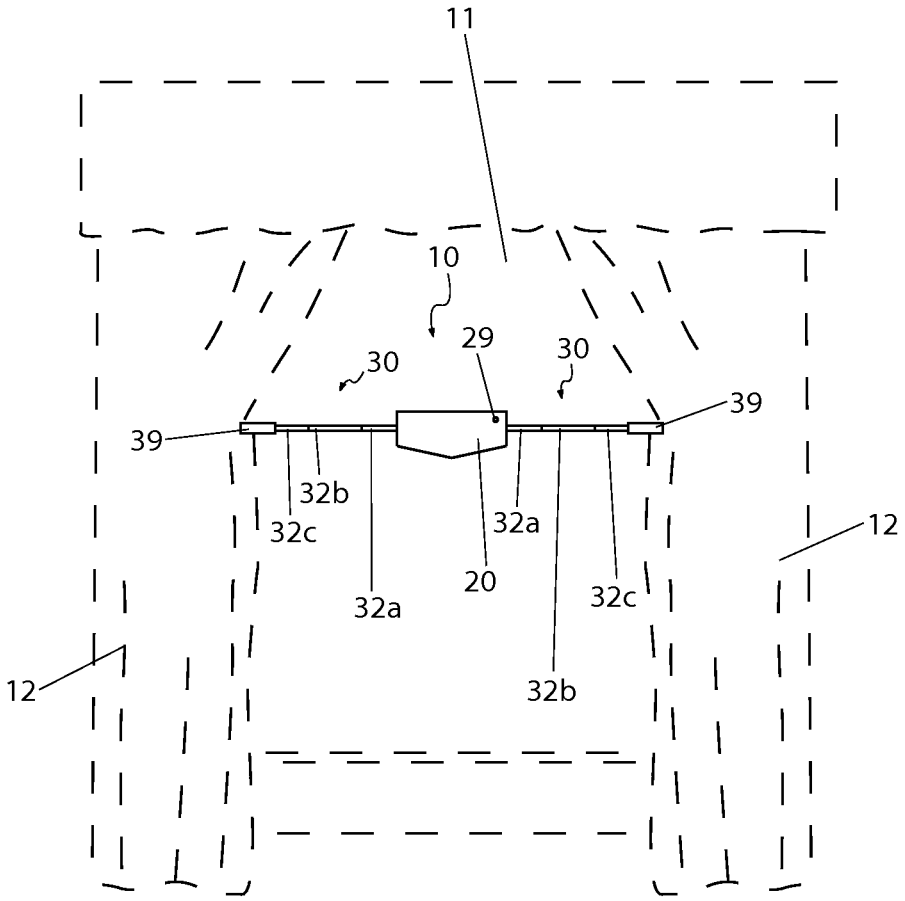
FIG. 2 is another environmental view of the motorized curtain opening and closing apparatus 10 depicting an open state, according to a preferred embodiment of the present invention.

Referring now to FIG. 1, an environmental view of the apparatus 10 depicting a closed state and FIG. 2, another environmental view of the apparatus 10 depicting an open state, are disclosed. The apparatus 10 is designed for automatic and manual adjustment of existing curtains 12 upon a window 11 based upon ambient conditions or user input. The apparatus 10 comprises a durable rectangular housing 20 which securely contains a motor assembly 22 and a plurality of electrical and electronic components. The motor assembly 22 motions of a pair of opposing telescoping arm assemblies 30 which are further removably attachable to opposing inner perimeter edges of the curtains 12. The motor assembly 22 is actuated by a sensor assembly 42 which receives input from ambient conditions, a remote controller 60, or by a manual actuator 25.

Figure 3:
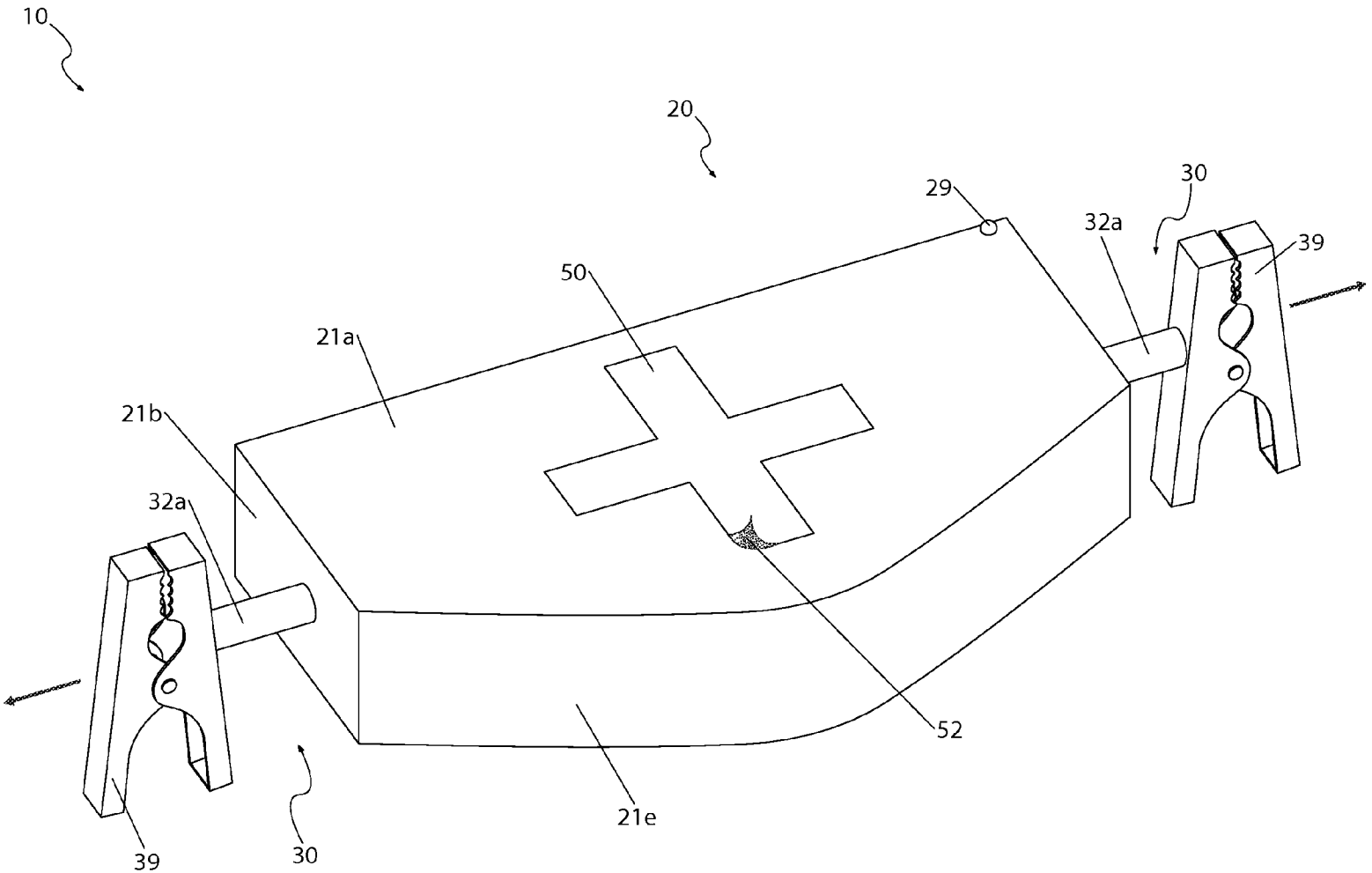
FIG. 3 is a front perspective view of the motorized curtain opening and closing apparatus 10, according to a preferred embodiment of the present invention.
Figure 4:
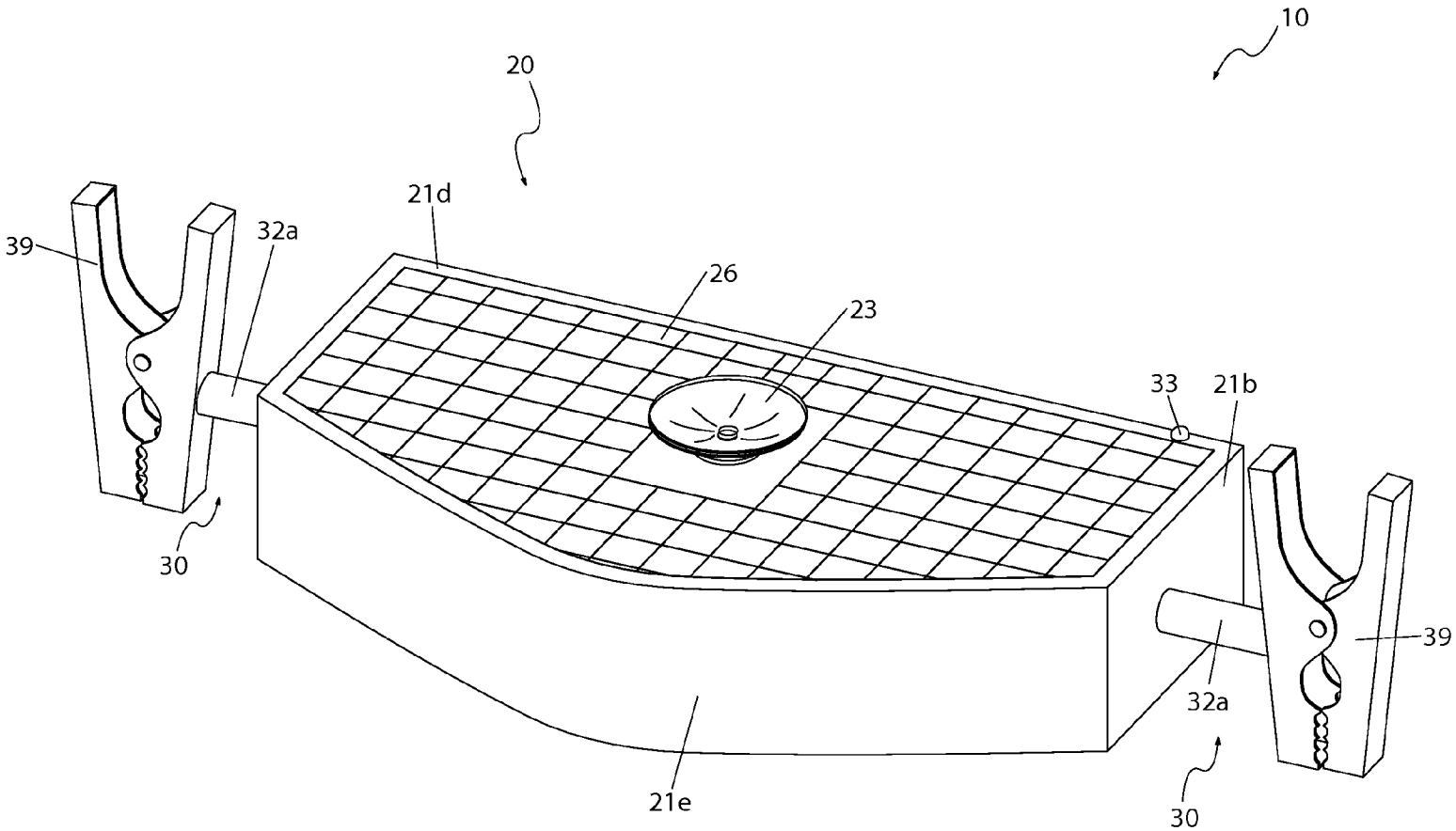
FIG. 4 is a rear perspective view of the motorized curtain opening and closing apparatus 10, according to a preferred embodiment of the present invention.
Figure 5:
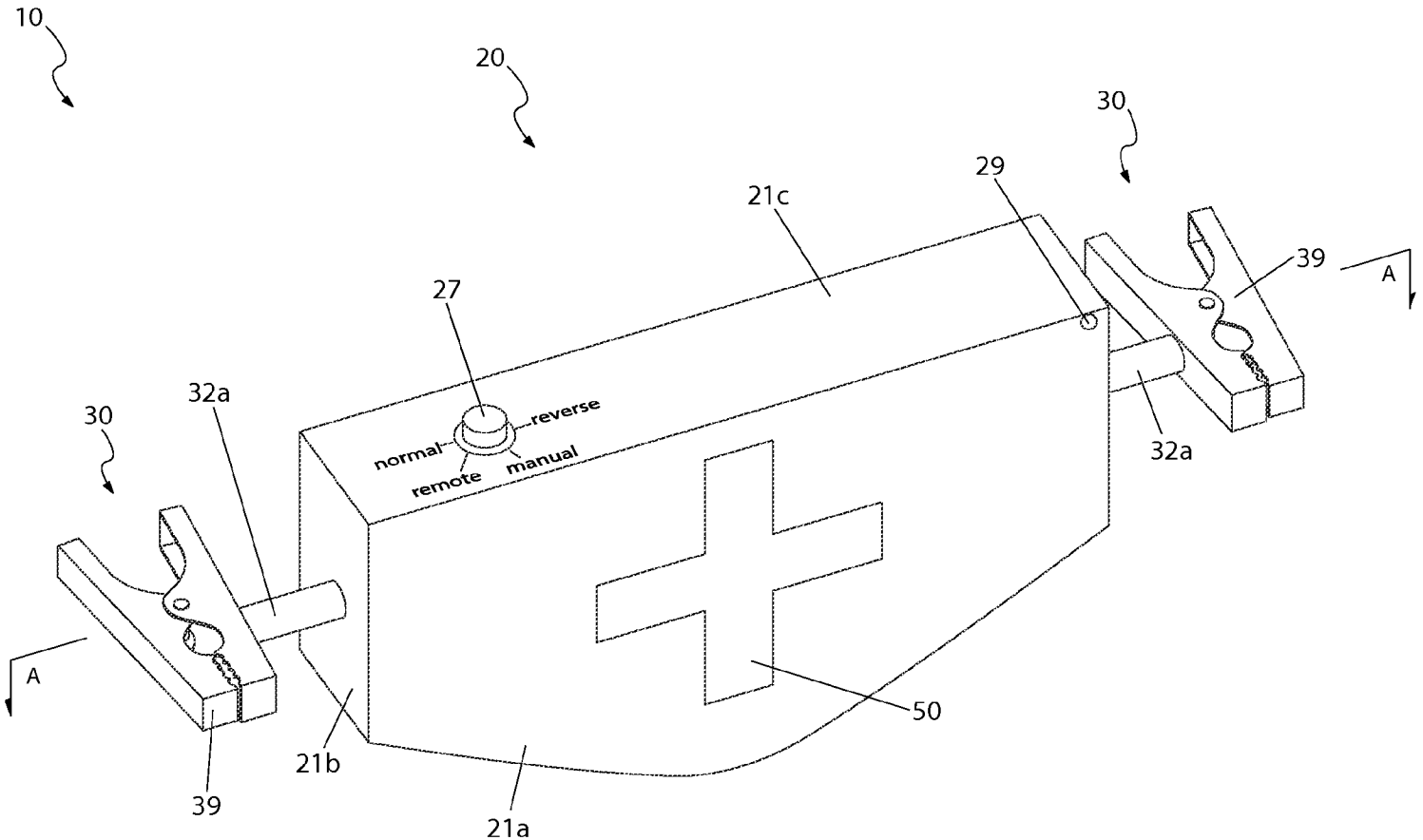
FIG. 5 is a top perspective view of the motorized curtain opening and closing apparatus 10, according to a preferred embodiment of the present invention.

Referring now to FIG. 3, a front perspective view of the apparatus 10, FIG. 4, a rear perspective view of the apparatus 10, and FIG. 5, a top perspective view of the apparatus 10, are disclosed. The rectangular housing 20 provides a protective enclosure to the motor assembly 22, a battery 24, at least one (1) solar cell 26, at least one (1) voltage regulator 28, a control circuit 40, a sensor assembly 42, and associated mechanical fasteners and electrical connectors. The housing 20 further encloses a transmission 34 and couplings 36 which translate rotational motion of the motor assembly 22 into linear motion in order to extend and retract the pair of telescoping arm assemblies 30 based upon input to the sensor assembly 42.

The housing 20 is comprised of a six-sided enclosure preferably fabricated from a durable plastic or similar material. The housing 20 includes an arcuately shaped bottom panel 21*e* to enhance the overall shape of the housing 20 for decorative purposes, yet it is known that the bottom panel 21*e* can also have various other shapes and is not considered a limiting factor of the apparatus 10. The housing 20 also includes a pair of opposing side panels 21*b* which provide support to and enable the telescoping arm assemblies 30 to pass through. The arm assemblies 30 include a variable length cylindrical structure telescopically extending perpendicularly outward from the surface of the housing 20. The length of each telescoping arm assembly 30 is controlled by actuation of the motor assembly 22 to drive an attached coupling 36. Each telescoping arm assembly 30 further includes a first cylindrical telescoping section 32*a*, a second cylindrical telescoping section 32*b*, and a third cylindrical telescoping section 32*c* (also see FIG. 6). The second telescoping section 32*b* includes an outer diameter less than the inner diameter of the first section 32*a* and the third telescoping section 32*c* includes an outer diameter less than the inner diameter of the second section 32*b*. In this manner, the sections 32*a*, 32*b*, 32*c* can be motioned relative to each other in order to adjust the overall length of the telescoping arm assembly 30 to open or close the curtains 12. While the apparatus 10 is illustrated as having three (3) sections, it is understood that other telescopically adjustable arm configurations may be provided to accommodate varying sizes, designs, and intended applications, and as such should not be interpreted as a limiting factor of the apparatus 10.

An exterior surface of each third telescoping section 32*c* further includes a spring clip 39. The spring clip 39 includes a removable clamp fastener for gripping a portion of the curtain 12. The spring clip 39 includes upper and lower jaw portions which are pivotingly connected by a spring hinge biased towards a closed position. It is understood that other fasteners such as alligator clips, adhesives, string ties, or hook and loop straps may be utilized to provide equal benefit to a user, and as such should not be interpreted as a limiting factor of the apparatus 10. The spring clips 39 fasten to an inner perimeter edge of the curtains 12 and they also assist in supporting the apparatus 10.

A rear panel 21*d* upon the housing 20 includes a suction cup 23 which provides an attachment means for the housing 20 to the window 11 and also assists in supporting the apparatus 10. The suction cup 23 is illustrated as being positioned at an intermediate location with the solar panel 26 encompassing the suction cup 23, yet other locations and amount of suction cups 23 can vary without limiting the scope of the apparatus 10. The suction cup 23 is attached to the rear panel 21*d* via adhesive, fasteners, or the like. The solar cell 26 includes a photovoltaic cell located along an outer rear panel 21*d* of the housing 20. The solar cells 26 are oriented facing towards the outside of a window 11 in order to intercept incoming light (also see FIG. 6).

A top panel 21*c* of the housing 20 includes a control knob 27 (also see FIG. 7) which enables the user to choose a desired mode. The control knob 27 is comprised of a multi-positional electrical knob which enables the user to choose a desired setting. Various electrical switching devices can be utilized to manipulate the apparatus 10 without limiting the scope of the invention. The control knob 27 can be positioned into a normal mode which activates the arm assembly 30 as the solar cell 26 detects incoming light, a remote mode which enables the user to activate the assembly with a remote controller 60 (see FIGS. 8 and 9), a manual mode which enables a user's touch upon a manual actuator 25 on the housing 20 to deploy the arm assembly 30, or a backwards mode which enables the arm assembly 30 to be activated when the solar cell does not detect incoming light.

A front panel 21*a* of the housing 20 provides a surface area for placement of various indicia 50. The indicia 50 is depicted as a cross for illustration purposes only it is known that other logos, shapes, or the like can be utilized as desired by the uses décor or wants without limiting the scope of the apparatus 10. The indicia 50 is adhered to the front panel 21*a* with an adhesive backing. The indicia 50 is preferably packaged with the apparatus 10 to enable the user to place the indicia 50 upon the apparatus 10 as desired, but can also be purchased separately from the apparatus 10.

The front panel 21*a* of the housing 20 also exposes a receiver 29. The receiver 29 can be located upon various positions upon the housing 20 without limiting the scope of the apparatus 10. The receiver 29 receives a signal 66 which is transmitted from a remote controller 60.

Figure 6:
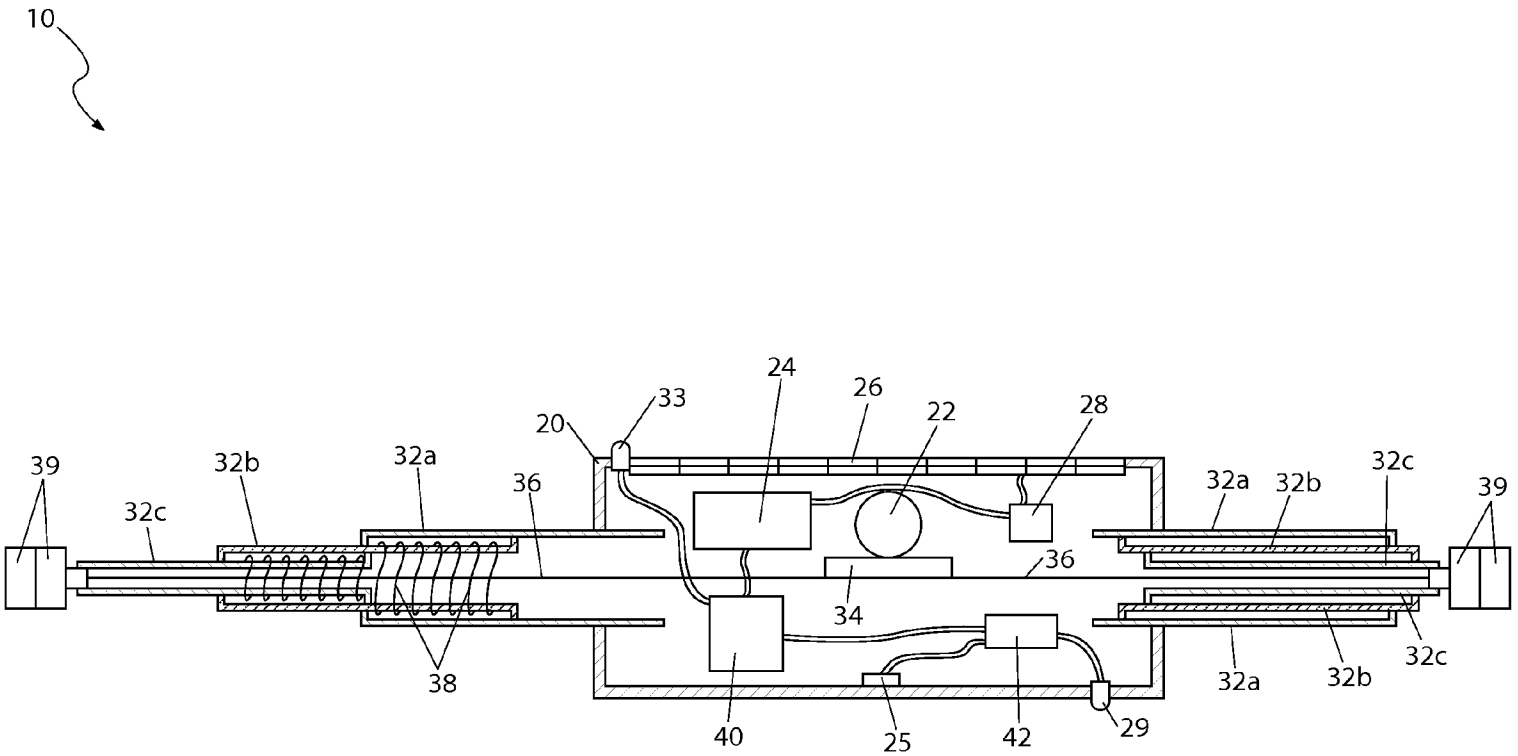
FIG. 6 is a sectional view of the motorized curtain opening and closing apparatus of line A-A (see FIG. 5), according to a preferred embodiment of the present invention.
Figure 7:
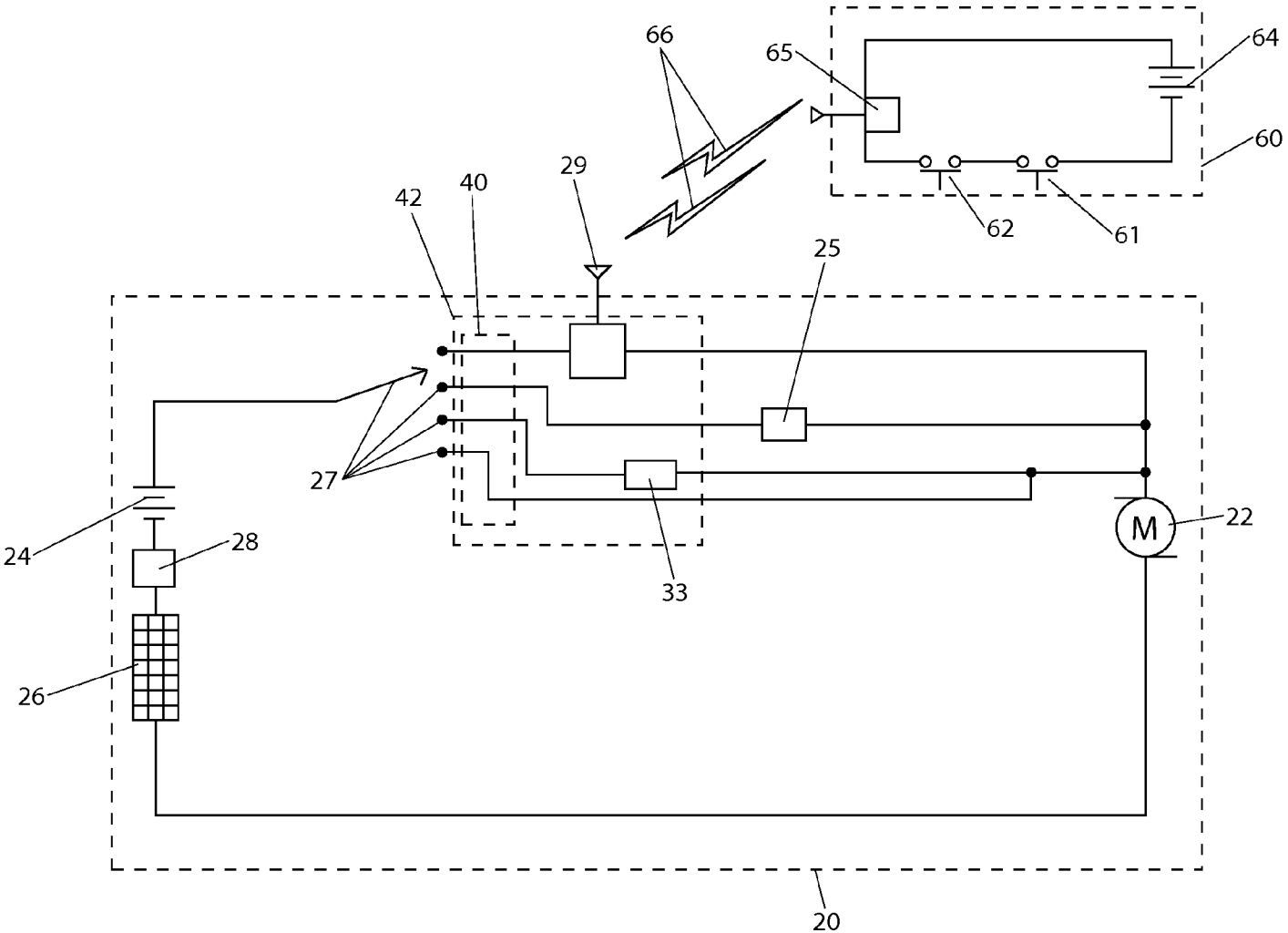
FIG. 7 is an electronic block diagram of the motorized curtain opening and closing apparatus 10, according to a preferred embodiment of the present invention.

Referring now to FIG. 6, a sectional view of the apparatus 10 and FIG. 7, an electrical block diagram of the apparatus 10, are disclosed. The motor assembly 22 includes at least one (1) reversible electrical motor powered by the integral battery 24. The motor assembly 22 is rigidly affixed within the housing 20 with the motor rotating about an axis perpendicular to a front surface of the housing 20. The transmission 34 which translates the rotating motion of the motor into proportioned bidirectional linear motion of the pair of couplings 36. In a preferred embodiment, the transmission 34 includes a reel and guide assembly which provides linear motion to a pair of cord couplings fixed to distal ends of each of the pair of telescoping arm assemblies 30.

Each telescoping arm assembly 30 also comprises a pair of integral spring mechanisms 38, one (1) located within the first telescoping section 32*a* and one (1) located within the second telescoping section 32*b*, which biases the telescoping arm assembly 30 outwardly extended state (see FIG. 6). An interior end surface of the third telescoping section 32*c* provides integral attachment to a cord coupling 36 which is securely attached to the spool and guide transmission 34 driven by the motor assembly 22. The spool provides a winding or unwinding of the cord coupling 36 by rotating of the motor assembly 22. The guide assembly includes a plurality of rigid sections which redirect the motion of the cord coupling 36 relative to the motor assembly 22 in order to appropriately engage and move the telescoping arm assemblies 30. The motor assembly 22 may be actuated in order to provide an inward linear motion to the cord coupling 36 in order to pull the first 32*a*, second 32*b*, and third 32*c* telescoping sections inward against the force of the spring mechanism 38. As the motor assembly 22 rotates in an opposite direction, the cord coupling 36 is unwound from the spool and outward force from the spring mechanism 38 causes the telescoping arm assemblies 30 to extend outward.

The integral battery 24 includes a compact chemical cell battery which provides electrical power to the motor assembly 22, the control circuit 40, and the sensor assembly 42. The battery 24 is a rechargeable chemical battery which is connected to the solar cells 26 via the voltage regulators 28. The solar cells 26 provide variable electrical current which is passed through the voltage regulator 28 in order to provide a recharging current of appropriate voltage to the rechargeable battery 24.

The control circuit 40 includes a printed circuit board (PCB) located on the interior of the housing 20 having on-board electronic components necessary for the operation of the apparatus 10 such as, but not limited to: microprocessors, memory chips, relays, embedded software, input and output signal capabilities (I/O), driver circuits, wiring connections, and multi-conductor cables which provide connection and communication with sensor assembly 42. The control circuit 40 receives input signals from the sensor assembly 42 such as a signal 66 from the remote controller 60. The control circuit 40 enables the motor assembly 22 to activate extending and returning of the telescoping arm assemblies 30. The control circuit 40 also enables the apparatus 10 to function backwards as desired by the user input from the control knob 27.

The sensor assembly 42 includes an electronic assembly which provides an input signal to the control circuit 40 based upon ambient or user controlled conditions in order to control the motor assembly 22. The sensor assembly 42 includes a photo sensor 33, an RF receiver 29, and a manual actuator 25. The photo sensor 33 includes a photoelectric sensor disposed along a rear panel 21*d* the housing 20 adapted to provide an input signal to the control circuit 40 based upon the ambient light level of the outdoors. In this manner, the control circuit 40 may be programmed with a pre-set light level that is compared to a light intensity signal generated and transmitted by the solar cell 26 to automatically open and close attached curtains 12, such as at dawn and dusk. The RF receiver 29, depicted as being located upon the front panel 21*a* of the housing 20, capable of receiving user-generated input signals from a corresponding remote control 60, thus allowing a user to override the positioning of the curtains 12 as desired. The manual actuator 25 is comprised of a capacitor which enables the user touching the housing 20 to complete the circuit send the signal to the control circuit 40 for activation of the telescoping arm assembly 30. It is understood that other sensor and control array combinations such as an integral keypad, motion sensors, proximity sensors, sound sensors, or the like may be utilized to provide a range of actuating signals suitable to various users, and as such should not be interpreted as a limiting factor of the apparatus 10.

The apparatus 10 is utilized by mounting it within a window 11 well. The user then attaches each half of the curtain 12 to the apparatus 10 with the spring clips 39.

The user may then select an actuating means for opening and closing the curtains 12 based upon the selection of the control knob 27 which controls the control circuit 40 and sensor assembly 42 to provide automatic or manual operation as desired. When the apparatus 10 is initially actuated, the motor assembly 22 is activated to motion the telescoping arms 32*a*, 32*b*, 32*c* outward from the center of the window 11 to pull the curtains 12 open. While the curtain 12 is open, the solar cells 26 receive sunlight and convert it to stored energy to recharge the battery 24. When the sensor assembly 42 is signaled due to ambient or user provided controls, the telescoping arm assemblies 30 are retracted in order to pull the curtains 12 closed.

Figure 8:
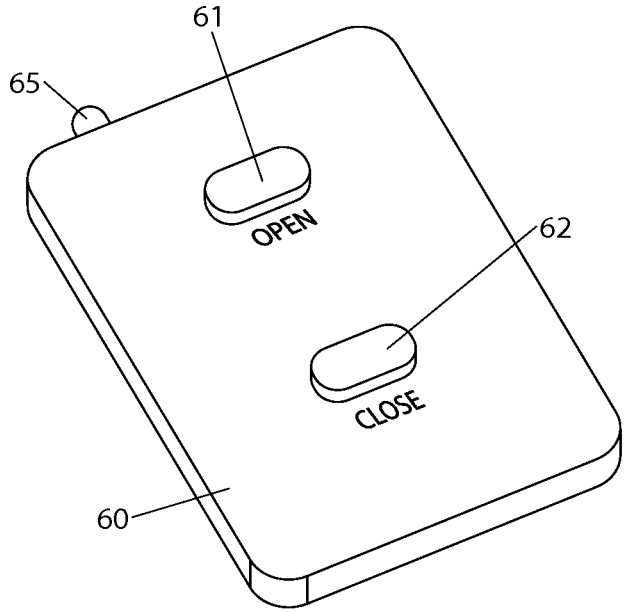
FIG. 8 is a front perspective view of a remote controller 60, according to a preferred embodiment of the present invention; and, FIG. 9 is a rear perspective view of the remote controller 60, according to a preferred embodiment of the present invention.
Figure 9:
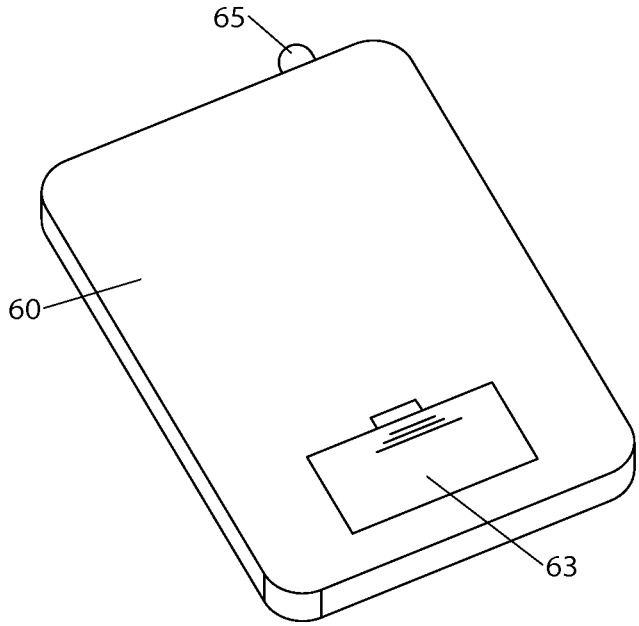

Referring now to FIG. 8, a front perspective view of the remote controller 60 and FIG. 9, a rear perspective view of the remote controller 60, are disclosed. The remote controller 60 is comprised of a generally rectangular hand-held device fabricated from a durable plastic. The remote controller 60 encompasses internal electronic components such as a remote battery 64 and a transmitter 65 (see FIG. 7). With the control knob 27 set at the remote control setting a user can depress a first button 61 which transmits a signal 66 through the transmitter 65 to open the curtain 12 or extend the telescoping arm assembly 30. The user can also depress a second button 62 to transmit a signal 66 through the transmitter 65 to close the curtain 12 or retract the telescoping arm assembly 30. The buttons 61, 62 are located on a front surface of the remote controller 60 and are preferably comprised of push buttons, yet other switches can be utilized without limiting the scope of the remote controller 60. A rear surface of the remote controller 60 comprises a battery compartment 63 which enables the user to access the remote battery 64 from common replacement needs.

It is envisioned that other styles and configurations of the present invention can be easily incorporated into the teachings of the present invention, and only one particular configuration shall be shown and described for purposes of clarity and disclosure and not by way of limitation of scope.

The preferred embodiment of the present invention can be utilized by the common user in a simple and effortless manner with little or no training. After initial purchase or acquisition of the apparatus 10, it would be installed as indicated in FIGS. 1 and 2.

The method of installing and utilizing the apparatus 10 may be achieved by performing the following steps: acquiring the apparatus 10; fastening the apparatus 10 to a desired set of curtains 12 by attaching each spring clip 39 to an inner perimeter edge of the curtains 12; engaging the suction cup 23 on the rear panel 21*d* with the window 11; placing a desired indicia 50 upon the front panel 21*a* of the housing 20 as desired; adjusting the control knob 27 to a desired setting; enabling the telescoping arm assembly 30 to deploy and retract as desired based upon the desired setting; and, utilizing the apparatus 10 to open and close curtains 12 in a manner which is effortless.

The method of utilizing the apparatus 10 with the remote controller 60 may be achieved by performing the following steps: acquiring the apparatus 10; fastening the apparatus 10 to a desired set of curtains 12 by attaching each spring clip 39 to an inner perimeter edge of the curtains 12; engaging the suction cup 23 on the rear panel 21*d* with the window 11; placing a desired indicia 50 upon the front panel 21*a* of the housing 20 as desired; adjusting the control knob 27 to the remote controller setting; inserting a remote battery 64 into the battery compartment 63 of the remote controller 60 as needed; depressing the first button 61 to deploy the telescoping arm assembly 30 as desired; depressing the second button 62 to retract the telescoping arm assembly 30 as desired; and, utilizing the apparatus 10 to open and close curtains 12 in a manner which is effortless.

The method of utilizing the apparatus 10 with the manual actuator 25 may be achieved by performing the following steps: acquiring the apparatus 10; fastening the apparatus 10 to a desired set of curtains 12 by attaching each spring clip 39 to an inner perimeter edge of the curtains 12; engaging the suction cup 23 on the rear panel 21*d* with the window 11; placing a desired indicia 50 upon the front panel 21*a* of the housing 20 as desired; adjusting the control knob 27 to the manual setting; touching the exterior surface of the housing 20 to deploy the telescoping arm assembly 30 as desired; touching the exterior surface of the housing 20 again to retract the telescoping arm assembly 30 as desired; and, utilizing the apparatus 10 to open and close curtains 12 in a manner which is effortless.

The foregoing descriptions of specific embodiments have been presented for purposes of illustration and description. They are not intended to be exhaustive or to limit to the precise forms disclosed and many modifications and variations are possible in light of the above teachings. The embodiments were chosen and described in order to best explain principles and practical application to enable others skilled in the art to best utilize the various embodiments with various modifications as are suited to the particular use contemplated.

What is claimed is:

1. An opening and closing apparatus for a curtain, comprising:

a durable housing; a motor assembly supported within said housing;

a pair of telescoping arm assemblies each operably driven by said motor assembly and extending outward from opposing sides of said housing;

a sensor assembly located on an exterior of said housing and in electrical communication with said motor assembly; and, a control means in electrical communication with said sensor assembly;

wherein said pair of telescoping arm assemblies are adapted to removably attach to said curtain; wherein said pair of telescoping arm assemblies each further comprises:

a first cylindrical telescoping section;

a second cylindrical telescoping section slidably engaged within said first telescoping section; a third cylindrical telescoping section slidably engaged within said second telescoping section; a gripping means attached to a terminal end of said third telescoping section; a first spring mechanism located internally within said first telescoping section; a second spring mechanism located internally within said second telescoping section; wherein said gripping means is removably connected to said curtain; wherein one of said pair of cord couplings is attached to an interior terminal end of said third telescoping section; wherein said first and second integral spring mechanisms biases each section towards an outwardly extended state;

wherein said sensor assembly further comprises: a photovoltaic cell located along an outer surface of said rear panel in electrical communication with said control means; wherein said cell gathers solar energy and stores said solar energy to said power source; and, wherein said cell detects a light intensity and generates and transmits a light intensity signal to said control means; wherein said control means is selectable between an automatic operation and a manual operation to control said motor assembly; and, wherein said motor assembly simultaneously drives said pair of telescoping arm assemblies to provide selectable incremental opening and closing of said curtain.

2. The apparatus of claim 1, wherein said housing further comprises a six sided enclosure with an arcuately shaped bottom panel, a top panel, a pair of opposing side panels which provide support to and enable said pair of telescoping arm assemblies to pass through, a front panel, and a rear panel.

3. The apparatus of claim 2, further comprising an attachment means located on said rear panel for removably attaching said housing to a support structure adjacent to said curtain.

4. The apparatus of claim 2, wherein said motor assembly further comprises:

at least one reversible electrical motor in electrical communication with a power source, said at least one motor rigidly affixed to an interior of said housing;

a transmission operably driven by said motor; and, a pair of cord couplings, each having a first end driven by said transmission and a second end affixed to one of said pair of telescoping arm assemblies.

5. The apparatus of claim 4, wherein said transmission further comprises:

a spool connected to an output of said motor to provide reversible winding of said pair of cord couplings; and, a guide, comprising a plurality of rigid sections which redirect the motion of each of said pair of cord couplings relative to said motor assembly.

6. The apparatus of claim 4, wherein said gripping means further comprises a spring clip.

7. The apparatus of claim 4, wherein said control means further comprises:

a control knob located on said top panel, said control knob selectable between said automatic operation and said manual operation, said control knob in electrical communication with said sensor assembly;

a manual actuator located on said top panel and in electrical communication with said control knob;

a circuit board located within said housing in electrical communication with said control knob and said motor assembly;

wherein said automatic operation operates said motor assembly when said light intensity signal directs an opening or a closing of said curtain;

wherein said light intensity signal is compared to a pre-set light level by said circuit board, such that said motor assembly opens said curtain when said light intensity signal is greater than said pre-set level and said motor assembly closes said curtain when said light intensity signal is lesser than said pre-set level;

wherein said manual operation operates said motor assembly when said manual actuator is contacted; and, wherein said manual operation provides for forward and reverse actuation.

8. An opening and closing apparatus for a curtain, comprising: a durable housing; a motor assembly supported within said housing;

a pair of telescoping arm assemblies each operably driven by said motor assembly and extending outward from opposing sides of said housing;

a sensor assembly located on an exterior of said housing and in electrical communication with said motor assembly and wireless communication with a remote control; and, a control means in electrical communication with said sensor assembly;

wherein said pair of telescoping arm assemblies are adapted to removably attach to said curtain; wherein said pair of telescoping arm assemblies each further comprises: a first cylindrical telescoping section; a second cylindrical telescoping section slidably engaged within said first telescoping section; a third cylindrical telescoping section slidably engaged within said second telescoping section; a gripping means attached to a terminal end of said third telescoping section; a first spring mechanism located internally within said first telescoping section; a second spring mechanism located internally within said second telescoping section; wherein said gripping means is removably connected to said curtain; wherein one of said pair of cord couplings is attached to an interior terminal end of said third telescoping section; wherein said first and second integral spring mechanisms biases each section towards an outwardly extended state, wherein said sensor assembly further comprises: a photovoltaic cell located along an outer surface of said rear panel in electrical communication with said control means; wherein said cell gathers solar energy and stores said solar energy to said power source; and, wherein said cell detects a light intensity and generates and transmits a light intensity signal to said control means, wherein said control means is selectable between an automatic operation, a manual operation, and a remote operation to control said motor assembly; and, wherein said motor assembly simultaneously drives said pair of telescoping arm assemblies to provide selectable incremental opening and closing of said curtain.

9. The apparatus of claim 8, wherein said housing further comprises a six sided enclosure with an arcuately shaped bottom panel, a top panel, a pair of opposing side panels which provide support to and enable said pair of telescoping arm assemblies to pass through, a front panel, and a rear panel.

10. The apparatus of claim 9, further comprising an attachment means located on said rear panel for removably attaching said housing to a support structure adjacent to said curtain.

11. The apparatus of claim 9, wherein said motor assembly further comprises:

at least one reversible electrical motor in electrical communication with a power source, said at least one motor rigidly affixed to an interior of said housing;

a transmission operably driven by said motor; and, a pair of cord couplings, each having a first end driven by said transmission and a second end affixed to one of said pair of telescoping arm assemblies.

12. The apparatus of claim 11, wherein said transmission further comprises:

a spool connected to an output of said motor to provide reversible winding of said pair of cord couplings; and, a guide, comprising a plurality of rigid sections which redirect the motion of each of said pair of cord couplings relative to said motor assembly.

13. The apparatus of claim 11, wherein said pair of telescoping arm assemblies each further comprises:

a first cylindrical telescoping section;

a second cylindrical telescoping section slidably engaged within said first telescoping section;

a third cylindrical telescoping section slidably engaged within said second telescoping section;

a gripping means attached to a terminal end of said third telescoping section;

a first spring mechanism located internally within said first telescoping section;

a second spring mechanism located internally within said second telescoping section;

wherein said gripping means is removably connected to said curtain;

wherein one of said pair of cord couplings is attached to an interior terminal end of said third telescoping section;

wherein said first and second integral spring mechanisms biases each section towards an outwardly extended state.

14. The apparatus of claim 13, wherein said gripping means further comprises a spring clip.

15. The apparatus of claim 11, wherein said sensor assembly further comprises:

a photovoltaic cell located along an outer surface of said rear panel in electrical communication with said control means;

wherein said cell gathers solar energy and stores said solar energy to said power source; and, wherein said cell detects a light intensity and generates and transmits a light intensity signal to said control means.

16. The apparatus of claim 15, wherein said control means further comprises:

a control knob located on said top panel, said control knob selectable between said automatic operation, said manual operation, and said remote operation, said control knob in electrical communication with said sensor assembly;

a manual actuator located on said top panel and in electrical communication with said control knob;

a receiver located on a front panel in wireless communication with said remote control;

a circuit board located within said housing in electrical communication with said control knob and said motor assembly;

wherein said automatic operation operates said motor assembly when said light intensity signal directs an opening or a closing of said curtain;

wherein said light intensity signal is compared to a pre-set light level by said circuit board, such that said motor assembly opens said curtain when said light intensity signal is greater than said pre-set level and said motor assembly closes said curtain when said light intensity signal is lesser than said pre-set level;

wherein said manual operation operates said motor assembly when said manual actuator is contacted;

wherein said manual operation provides for forward and reverse actuation; and, wherein said remote operation operates said motor assembly when said receiver receives a control signal from said remote control.

17. The apparatus of claim 16, wherein said remote control comprises a hand-held device comprising:

a transmitter;

a first button in electrical communication with said transmitter that transmits an extending signal;

a second button in electrical communication with said transmitter that transmits a retracting signal; and, a remote control power source in electrical communication with said transmitter.

* * * * *